United States Patent [19]

Hess et al.

[11] Patent Number: 4,825,915

[45] Date of Patent: May 2, 1989

[54] FUNNEL CONSTRUCTION SYSTEM

[76] Inventors: Bergen Hess, 412 2nd St., Alexandria, Va. 22134; Vincent L. Ramik, 4966 Sabra La., Annandale, Va. 22003

[21] Appl. No.: 121,714

[22] Filed: Nov. 17, 1987

[51] Int. Cl.[4] ..... B67C 11/00; B65B 39/00

[52] U.S. Cl. ..... 141/337; 141/392; 383/36; 493/287

[58] Field of Search ..... 141/333, 337, 338, 392, 141/331; 383/36; 229/119, DIG. 7; 493/287, 288

[56] References Cited

U.S. PATENT DOCUMENTS 1,960,232 5/1974 Corbe ..... 141/337

2,100,888 11/1937 Vine ..... 141/337

3,750,722 8/1973 Nowak ..... 141/333 X

FOREIGN PATENT DOCUMENTS 2497786 7/1982 France ..... 141/337

*Primary Examiner*—Ernest G. Cusick

*Attorney, Agent, or Firm*—Diller, Ramik & Wight

[57] ABSTRACT

A disposable funnel defined by a generally frusto-conical tubular sheet material body having longitudinally opposite ends defining openings of two different sizes, at least one bond line between the opposite ends defining a longitudinal bonded seam of the body, and a torn edge along the longitudinal bonded seams along which the funnel is torn from other generally identical funnels of a funnel sheet in planar, folded or rolled-up form.

11 Claims, 2 Drawing Sheets

FIG. 1
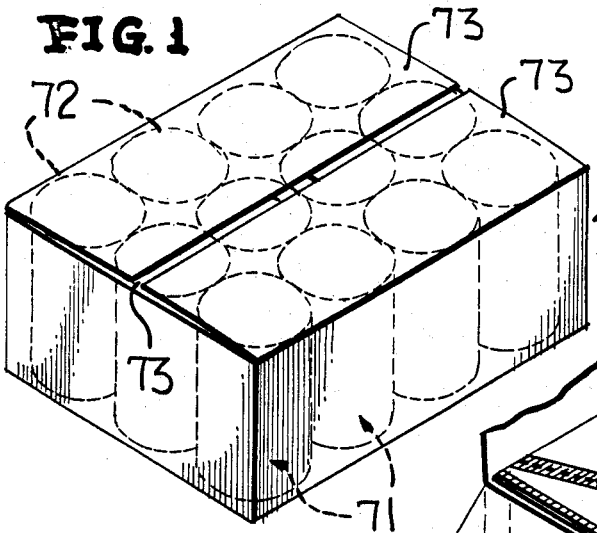
FIG. 2
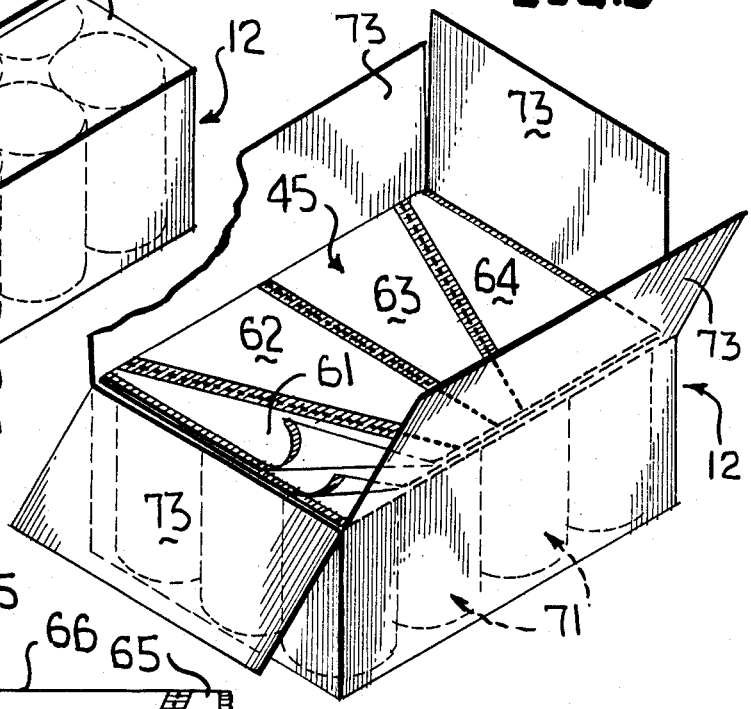
FIG. 3
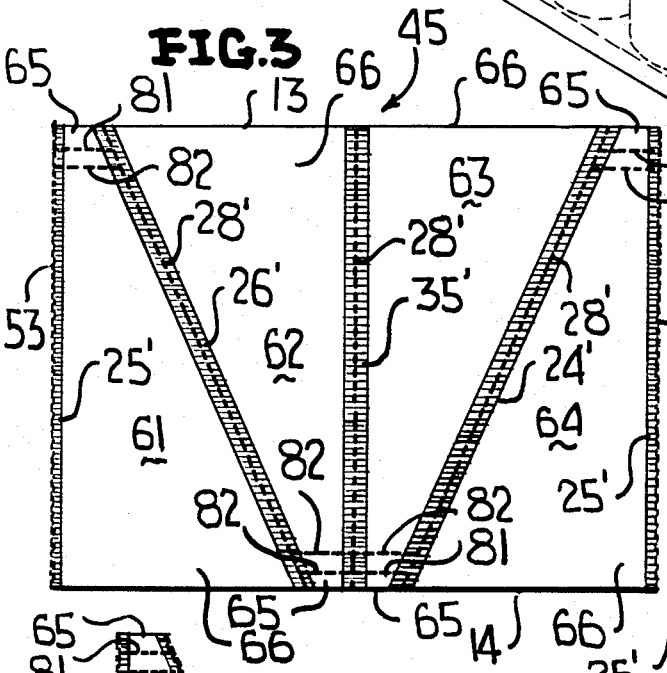
FIG. 4
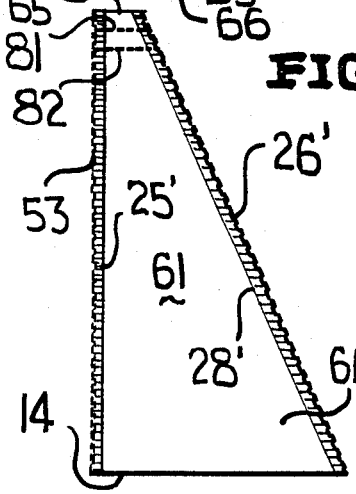
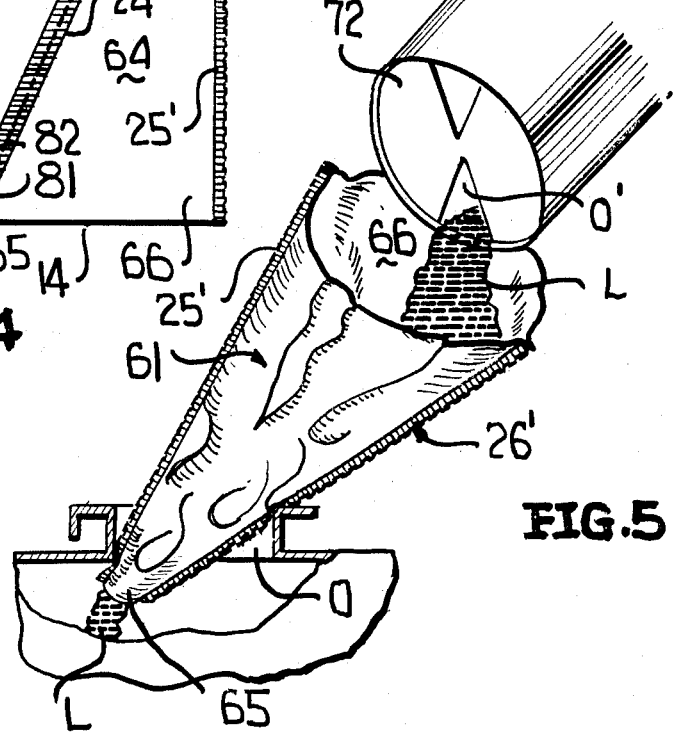
FIG. 5

FUNNEL CONSTRUCTION SYSTEM

BACKGROUND OF THE INVENTION

This invention is directed to a funnel for pouring liquids, powders and the like into containers that have small openings, and particularly for pouring oil or like products into the crankcase opening of motor vehicles, such as automobiles, trucks and the like.

Conventional funnels are customarily constructed in the form of an inverted cone having axially opposite large and small opening ends, with the small end being inserted in a small opening of a container and the large end being utilized to receive the poured flowable material. Typical funnels are made of metal and plastic, and most recently funnels which are specifically designed for filling automotive crankcases are made of plastic and are quite long to permit easy access to the crankcase opening. In the absence of a funnel it is virtually impossible to pour oil, for example, from a "conventional" oil can having a cylindrical body and opposite circular ends. When an end of such a conventional oil can is opened and tipped, the oil initially flows therefrom in a sporadic fashion because of the viscosity of the product and the sporadic introduction of air into the oil can to replace the oil being dispensed therefrom. Furthermore, most automotive/truck engines have the crankcase opening so located that it is virtually impossible to tip a conventional oil can and pour the oil therefrom into the crankcase opening without spilling some oil upon the engine, frame, or associated areas. Even plastic extruded oil cans having longer tapering necks suffer from the latter disadvantage, although the conical ends do facilitate the introduction of the oil into the crankcase opening with at least a better chance of avoiding spillage than flat-ended conventional oil cans. However, a custom with plastic extruded oil cans is to place one's thumb over the opened end, invert the oil can, position the end near the crankcase opening and remove one's thumb. While this avoids the spillage, it does, of course, deposit oil on the user's thumb which is readily transferred to the user's clothing or other undesirable areas. Accordingly, all oil can/bottles present pouring and disposal problems, and conventional funnels, though lessening such problems, introduce others of their own.

Typically, when a conventional funnel has been used to introduce oil into an automotive crankcase opening, the funnel is removed, and as the funnel is being removed, it is virtually impossible to prevent oil from dripping outwardly from the smaller end. If the funnel is tilted to a generally horizontal position, the tendency is for the oil adhering to the interior of the funnel to flow toward and upon the user's hand as the funnel is being withdrawn and inverted, at least partially, during withdrawal from the engine compartment area of an associated automobile/truck or similar vehicle. Furthermore, the inherent viscosity of oil clings to the internal surface of such funnels and irrespective of the manner of funnel storage, the oil eventually migrates from the interior surface of the funnel to, upon and generally penetrates whatever support area is adjacent thereto. Typically user's of such funnels place a rag upon the ground in a garage, tool shed or the like, place the funnel upon the rag with the small end pointing downwardly, and the oil drains upon the rag. This prevents the underlying surface from being soiled/penetrated by the oil, but the oily rags themselves are fire hazards.

SUMMARY OF THE INVENTION

The present invention is directed to a novel, inexpensive, compact and disposable funnel which avoids all of the disadvantages of conventional funnels and, just as importantly, can be used to virtually eliminate all undesired dripping and avoid dangerous after-use storage.

In keeping with the present invention, the novel disposable funnel is constructed from sheet material preferably drawn from a pair of rolls and superimposed in a pair of webs which are selectively heat-sealed and perforated to form a series of interconnected funnels in the form of a continuous web of funnels which can be selectively cut into sheets of funnels and from these sheets individual funnels can be selectively removed, used and discarded after a single use.

In further accordance with the present invention the novel disposable funnels of this invention are formed as adjacent interconnected pairs with the smaller ends of the funnel of each pair being axially opposite to each other thereby resulting in the formation of each pair of funnels without any waste whatsoever of the web material from which the funnels are formed, and in this fashion the expense/cost per disposable funnel is extremely minimum.

The sheets of funnels are also so sized in accordance with this invention that a preselected number of such sheets will correspond in peripheral dimensions to the peripheral dimensions of an associated outer container in which a conventional number (12) of oil cans are packaged. As an example, in a typical "case" of oil, twelve oil cans are packaged therein and in accordance with this invention three sheets of four disposable funnels per sheet are packaged in the container, and each funnel sheet has a length and width corresponding to the length and width of the case. Therefore, the three funnel sheets can simply be placed upon the tops of the oil cans after the latter have been packaged in the case and the flaps of the case closed. When cases so packaged are purchased in bulk, the user simply opens the case flaps and he has before him not only twelve cans of oil but twelve disposable funnels which can be used individually, one per can of oil, or as need be depending upon the particular task at hand. For example, a typical oil change might require four to six cans of oil, and if the task at hand is to change the oil of an automobile, one of the funnels can be removed along the line of weakness from a single funnel sheet and only the single funnel need be used for this particular task leaving, of course, eleven additional funnels for future use. However, if the person does not change his oil but merely buys the oil to replenish oil burnt or "thrown" by the engine, the user could use each disposable funnel with a new can of oil. This would be a highly desirable approach in situations where the user knows his automobile burns oil and carried one or more "spare" cans of oil to replenish oil burnt/thrown during a prolonged trip. Because of the present invention, the user can also take along the requisite number of disposable funnels, use these as need be as oil is added to the engine, and dispose of the disposable funnels, as used.

With the above, and other objects in view that will hereinafter appear, the nature of the invention will be more clearly understood by reference to the following detailed description, the appended claims and the several views illustrated in the accompanying drawings.

BRIEF DESCRIPTION OF THE DRAWINGS

FIG. 1 is a perspective view of a conventional case of oil, and illustrates an outer case housing twelve conventional cans of oil and flaps closing the case.

FIG. 2 is a top perspective view of the case of oil of FIG. 1, and illustrates the flaps opened to expose three sheets of disposable funnels with each sheet consisting of four disposable funnels.

FIG. 3 is a top perspective view of one of the funnel sheets of FIG. 2, and illustrates four funnels thereof with the funnels being set-off from each other by bond lines/heat seals and associated lines of weakness/perforations.

FIG. 4 is a top perspective view of one of the funnels of the funnel sheet of FIG. 3, and illustrates the funnel after having been removed from the funnel sheet along one of the lines of weakness/perforations.

FIG. 5 is a fragmentary perspective view of the inlet of an automotive crank case, and illustrates the funnel of FIG. 4 in use as oil is poured from an associated one of the oil cans of FIGS. 1 and 2.

DESCRIPTION OF THE PREFERRED EMBODIMENTS

Figure 6:
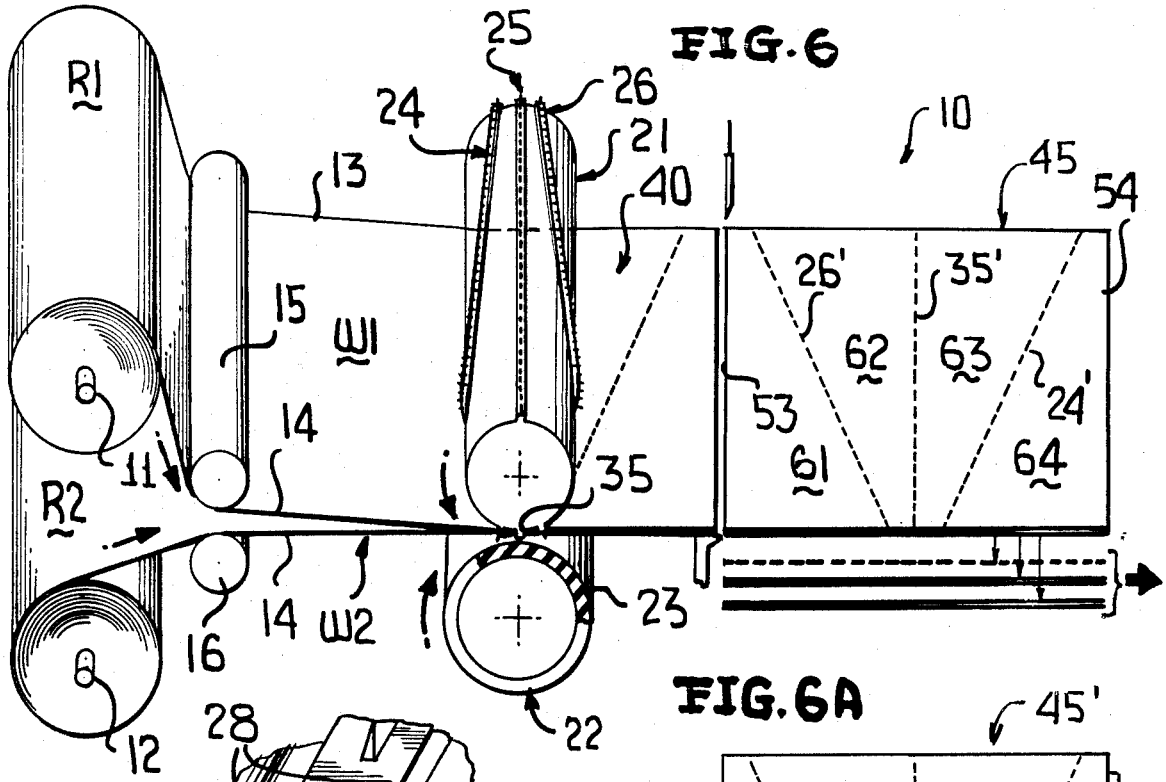
FIG. 6 is a schematic top perspective view of the apparatus for forming the funnel sheets of FIGS. 2 and 3, and illustrates a pair of webs drawn from a pair of rolls in superimposed relationship, heat-sealed and perforated, and subsequently cut and stacked to form the funnel sheets of FIGS. 2 and 3.

Reference is first made to FIG. 6 which illustrates a novel apparatus 10 which includes a pair of shafts 11, 12 for conventionally supporting rolls R1, R2 from which are respectively drawn webs W1, W2 each having respective longitudinal edges 13, 14. The webs W1, W2 can be formed from a variety of different materials, as, for example, flexible paper stock material having on the surfaces (unnumbered) opposing each other an extremely thin lamination of polymeric or copolymeric plastic material, such as polyethylene or the like which renders the flexible paper liquid impermeable and facilitates the selective bonding/heat-sealing of the webs W1, W2 to each other, as will be described more fully hereinafter. The webs W1, W2 can be simply single-ply sheets of plastic material, such as polyethylene or similar polymeric or copolymeric material, although laminated paper stock material is preferred. The webs W1, W2 pass through a series of opposing pairs of driven and idler rollers, such as the rollers 15, 16, and other such rollers are not illustrated and are well known in the industry.

As the webs W1, W2 are drawn from left-to-right in FIG. 6, they pass into, between and through the bight (unnumbered) of the heat sealing and perforating roll or roller 21 and a back-up roller 22, both of which are suitable supported by conventional mechanisms (not shown) and oppositely driven in synchronous fashion by similar conventional mechanisms (also not shown) in the direction of the unnumbered headed arrows associated therewith. The back-up roll 22 includes an outer annular or tubular sheath or sleeve 23 of resilient rubber, plastic or similar material of a suitable diameter hardness to provide back-up to the heat-sealing and perforating roller 21 in a conventional manner.

Figure 7:
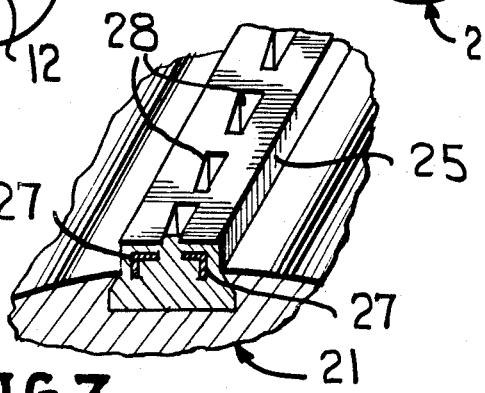
FIG. 7 is a fragmentary perspective view of a heat sealing/bonding and perforating roller of FIG. 6, and illustrates resistance heaters and teeth for respective forming heat seams/bonds and lines of perforation between adjacent funnels of each funnel sheet.

The heat sealing and perforating roller 21 carries four heat sealing and perforating bars 24, 25, 26 and 35 which are of a generally identical construction, as is best illustrated by the heat-sealing and perforating bar 25 of FIG. 7. The heat-sealing and perforating bar 25, as well as the remaining bars 24, 26 and 35, is formed of highly heat-conductive material and has imbedded therein one or more resistance heaters 27 which are connected to a suitable electrical source (not shown) which when energized heats the bar 25 (as well as the bars 24, 26 and 35) to a sufficient temperature to melt/heat-seal/bond the polyethylene or similar heat-sealable coating on the opposing surfaces of the webs W1, W2. The bar 25 lies along a diametrical center-line of the heat-sealing and perforating roller 21 and is diametrically opposite the identical heat-sealing and perforating bar 35. In other words, a diametric plane through the axis (unnumbered) of the heat-sealing and perforating roller 21 passes through a center-line of the bars 25, 35 and through the center of the projections 28. The heat-sealing and perforating bars 24, 26 have axially opposite ends which are adjacent to but circumferentially spaced from an associated end of each of the bars 25, 35. In FIG. 6 the "uppermost" illustrated ends (unnumbered) of the bars 24, 26 are closely adjacent but spaced from the "uppermost" end of the bar 25 while the "lowermost" ends (also unnumbered) of the bars 24, 26 are adjacent but circumferentially spaced from the "lowermost" end of the bar 25. The bars 24, 26 are also symmetrically positioned along and across the periphery or circumference of the roller 21. This symmetrical arrangement of the bars 24 through 26 and 35 creates a symmetrical pattern (FIG. 6) as the webs W1, W2 pass through the bight of the heat-sealing and perforating roller 21 and the back-up roller 22 resulting in the formation of a continuous funnel web 40 which can be selectively transversely severed by a conventional shear 41 to form a repetitive pattern funnel sheet 45 which is best illustrated in FIG. 3 to which attention is now directed.

The funnel sheet 45 is defined or set-off between the edges 13, 14 which are generally in spaced parallel relationship and opposite cut edges 53, 54 formed by the continuous operation of the shear 41. The funnel sheet 45 also includes heat-seals or bond lines 24', 25', 26' and 35' formed by the respective heat sealed bars 24, 25, 26 and 35 as the webs W1, W2 pass between the rollers 21, 22. The heat-seal line 25' is illustrated in FIG. 3 adjacent each cut edge 53, 54 because the shear 41 cut the funnel sheet 45 along the center-line of the heat-seal 25' thereby splitting the heat-seal 25' into the two "halves" shown in FIG. 3. As the heat-seal/bond lines 24', 25', 26' and 35' are continuously formed during the rotation of the rolls 21, 22, each is also weakened along its center-line by the teeth 28 forming the medial lines of perforation 28' (FIG. 3) in each of the bond lines or heat-seals 24, 25', 26' and 35'. Of course, the cut lines 53, 54 are along the line of perforation 28' of the heat-seal 25'.

Due to the symmetrical disposition of the bars 24 through 26 and 35, the resultant funnel sheet 45 defines four symmetrical disposable funnels 61 through 64 each having a small open end 65 opposite a large open end 66 with each pair of adjacent funnels or funnel sheets being connected to each other by an associated bond line or heat seal. As an example, the disposable funnel 61 is set-off by the left half of the heat-seal 25', the heat-seal 26', small upper opened end 65 and a large opened end 66. The next adjacent funnel or funnel sheet 62 is set-off by the heat-seal 26', the heat-seal 35', the small opened end 65 and the large open end 66. The next adjacent funnel or funnel sheet or disposable funnel 63 is set-off by the heat-seal 28', the heat-seal 24', the small open end 65 and the large opened end 66. Finally, the last of the four funnels 64 is set-off by the heat-seal 24', the other half of the heat-seal 25', the small open end 65 and the large open end 66. The pattern of the sheet 45 is repeated in an apparent manner and a further description thereof is unnecessary, although it is to be noted that each pair of funnels between each pair of adjacent parallel heat-seal lines have a common line of heat-sealing and the respective larger and smaller open ends are adjacent each other. As an example, the pair of funnels 63, 64 are set-off between the heat-seal lines 35', 25' and are spaced from each other by the diagonal heat-seal 24' and the large open end 66, 66 of the funnel 63, 64 are adjacent the smaller open end 65 of the respective adjacent funnels 64, 63. Because of this symmetrical relationship/pattern, there is absolutely no waste of material in the formation of each funnel sheet 45 and, moreover, the size of each funnel sheet 45 corresponds generally identically to the size of an associated conventional oil case 12 (FIGS. 1 and 3) containing twelve conventional quart oil cans 71 having conventional "flat" opposite ends or closures 72. Accordingly, once the cans 72 have been packaged in the case 12, three of the funnel sheets 45 can be packaged therein, as shown in FIG. 2, and associated flaps 73 of the case 12 can then be closed and sealed (FIG. 1).

When it is desired to use any of the funnels 61 through 64, etc., the flaps 73 are opened and, for example, one of the funnels 61 (FIG. 4) is detached from the adjoining funnel 62 by carrying along the line of perforations 28'. The funnel 61 is then inserted with its smaller end 64 in, for example, a crankcase filler opening O and appropriate openings O' (FIG. 5) are formed in the end or closure 62 of one of the oil cans 71. The oil or similar liquid L is then poured into the large opening 66 of the diposable funnel 61 and flows through the smaller end 65 thereof into the crankcase, as is readily apparent from FIG. 5. Once the oil L has been dispensed from the can 71, the can is quickly inverted and discarded without spillage. The funnel 61 is then carefully removed from the opening O and while the opened end 65 overlies but has been withdrawn from the opening O, the funnel 61 can be carefully folded in half by simply folding the lower open end 65 upwarding toward the end 66. Since the material of the funnel 61 is very flexible, this folding can be accomplished very easily and quickly and results in a lower fold line across a medial portion of the funnel 61 with the ends 65, 66 being uppermost therefrom and adjacent each other. When thus positioned, any oil which remains in the funnel 61 simply flows fromt he adjacent ends 65, 66 toward the fold therebetween and can not exit the funnel 61 to be inadvertently deposited upon the engine or components thereof. Furthermore, with minimal care it is virtually impossible for any of the oil in the funnel 61 to be deposited upon the user's fingers, clothing, etc. Obviously, the funnel 61 can be quickly discarded into an appropriate trash container and storage thereof is unnecessary.

While an equal number of funnels and cans of oil 72 have been packaged in the case 12, it is to be understood that each of disposable funnels is of sufficient integrity to have the contents of all of oil cans 72 poured therethrough. Twelve funnels have been associated with the case 12 because this is the normal number packaged in a conventional case and, more importantly, the four funnels per funnel sheet 45 and the size of each funnel creates individual funnels of precise length and opening sizes to be so packaged in a total of twelve funnels per case, four funnels per sheet.

Figure 6A:
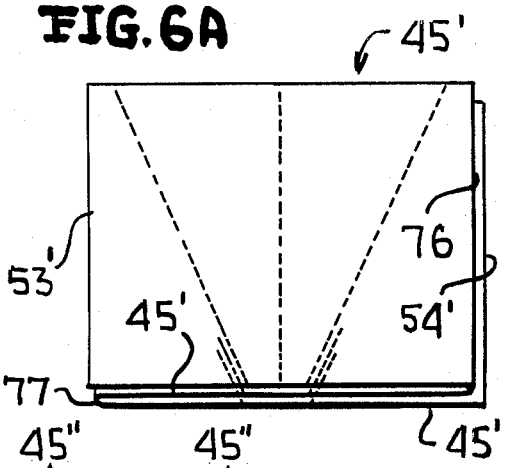
FIG. 6A is a perspective view of twelve funnels of a single funnel sheet, and illustrates the funnel sheet being folded into three equal portions.

An alternative to forming the funnel sheets 45 as shown in FIG. 3 to include but four funnels 61 through 64 is to form a funnel sheet 45' (FIG. 6A) which is formed of three funnel sheets each generally identical to the sheet 45 but in lieu of the edges 53 of the funnel sheet 45, the funnel sheets 45' are joined to each other along fold lines 76, 77. In other words, rather than utilizing the shear 41 to cut the funnel sheets 45 to include four funnels per funnel sheet, the shear 41 is operated to cut along edges 53', 54' between which there are a total of twelve funnel sheets. Obviously, when folded in the manner shown in FIG. 6A, the single folded funnel sheets 45' will fit generally precisely within the peripheral dimensions of the case 12, just as prior described relatively to the three funnel sheet 45.

Figure 8:
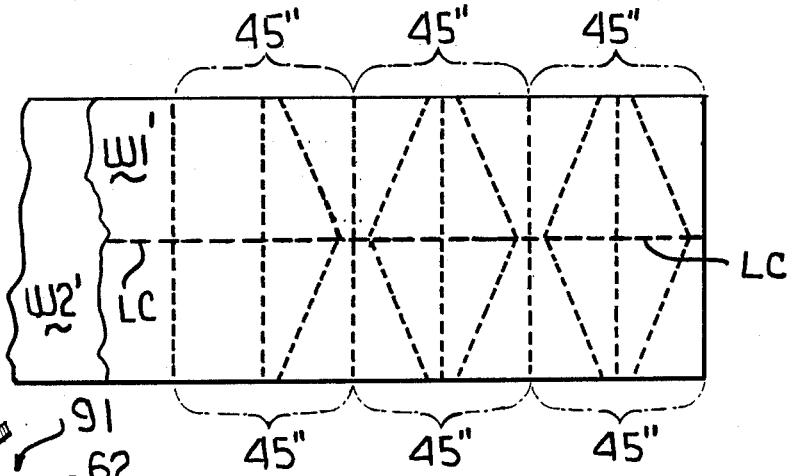
FIG. 8 is a schematic view fragmentary top plan view of a funnel sheet as it is being formed by the apparatus of FIG. 6.

Turning now to FIG. 8, a pair of webs W1' and W2' are illustrated and include a longitudinal center-line LC. The portion of the webs W1', W2' "above" the center-line LC corresponds identically to the webs W1, W2 and the pattern of funnel sheets 45 resulting upon the operation of the apparatus 10, as heretofore described. Below the longitudinal center-line LC, the pattern shown in FIG. 8 is a mirror image of the upper pattern. By beginning with webs W1' and W2' which are twice the width of the webs W1, W2 and duplicating in mirror image form the rollers 21, 22, the webs W1', W2' will be essentially formed in opposite mirror images and upon being cut along the longitudinal center-line LC, identical sets of funnel sheets 45" can be made. This reflects double production at speeds identical to the operation of the apparatus 10 by simply utilizing wider webs W1', W2', a mirror set or extension of the rollers 21, 22, and, of course, a slitter to cut the adjoining funnel sheets along the longitudinal center-line LC.

While the funnel sheets 45, 45' and 45" have been described as being cut into individual funnel sheets or folded funnel sheets, it is to be understood that any one of these can be formed into a roll of, for example, 100 funnel sheets; the roll placed in a dispensing carton, and individual funnels removed therefrom, as is typical in such conventional items as aluminum foil, "Saran wrap material, wax papaer, etc. Such rolls of the funnel sheets 45, 45' and 45" can be purchased by a consumer in such roll form, each in a separate carton without, of course, being associated with oil or any specific product. There are many household usages for funnels, particularly disposable funnels, such as pouring "cooking" grease into disposable containers, pouring the contents of large volume containers (quarts or gallons) into smaller dispenser-sized containers, such as pouring salt into salt shakers and ketchup from large bottles into plastic squeeze-type dispensers; pouring powder garden products into liquid garden hose aerator dispensers returning paint from roller containers to the original paint containers, etc. In many and/or most of the uses it is highly advantageous to simply discard the funnel after use since clean-up and retention for future uses is difficult, time-consuming, etc. By providing a dispensing container of the funnel sheets 45 in roll form, all of these problems are totally eliminated by the novel disposable funnel of this invention.

Though the undersigned is not limited to a particular size of the overall funnel sheet 45 or any of the individual funnels 61 through 64 thereof in the preferred embodiment of this invention, the funnel sheet 45 is preferably 15¾ by 12 inches as measured along the edges 13, 14 and 53, 54, respectively. These sizes of length and width respectively correspond to the internal dimension/opening of the container 12. Additionally, the length of the diagonal heat-seals 26', 28' are approximately 13 inches resulting in each of the funnels 61 through 64 having a one inch length along the edge 13 adjacent each small opoening 65 and the length of approximately 6¾ inches along the edge 14 of the larger openings 66.

It is also in keeping with the present invention to provide any one of the funnel sheets, such as the funnel sheet 45, with one or more lines of perforations 81, 82 at the small ends 65 of the individual funnels 61 through 64 (FIG. 3). If, for example, the end 65 of the funnel 61 (FIG. 4) is torn along the line of perforations 81, the opening thereof is enlarged and is enlarged further if torn along the line of perforations 82. In this manner though each funnel is provided with a relatively small opening, it can be readily enlarged by tearing along the lines 81, 82 or further ones of such lines of perforations. These lines are, of course, provided during the manufacture of the funnel sheets 45 by the apparatus 10 in a conventional fashion, namely, providing teeth or projections, such as the teeth or projections 28, the axially opposite ends of the roller 21 between the bar 25 and the bars 24, 26 at their most adjacent points and between the bar 27 and the bars 24, 25 at their most adjacent points.

Figure 9:
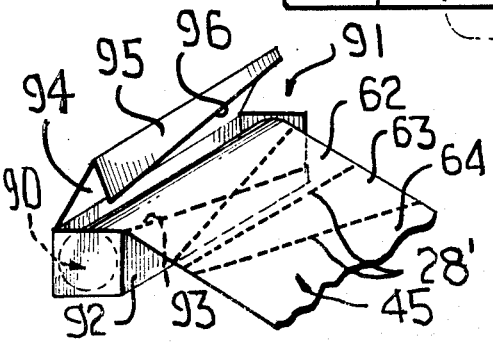
FIG. 9 is a perspective view of a roll of funnels, and illustrates the funnels being removed from a carton.

As shown in FIG. 9, the funnel sheet 45 can be formed into a roll 90 and inserted into a container 91 much in the manner in which aluminum foil, wax paper, "Saran" wrap, baggies, and the like are packaged and subsequently utilized with associated products. In this case, the container 91 is of a length corresponding to the distance between the longitudinal edges 13, 14 (FIG. 6), and the shear 41 is not operated until, for example, the roll 90 consists of 50, 75, 100 or like numbers of funnels 61 through 64 which can be, of course, individually torn from the funnel sheet 45 when unrolled from the container 91. Obviously, each funnel 61–64, etc. can be selectively torn along the associated lines of perforation 28'. In order to assist tearing the individual funnels 61–64, etc. from the roll 90 the container or container body 91 includes a front panel 92 having an upper terminal cutting edge 93 and a hinged cover 94 having a flap 95 which ends in a free cutting terminal edge 96. The edges 93, 96 are oppositely inclined to each other, can be serrated, may include a metallic serrated strip, but due to the opposite inclination thereof, the same can be alternatively utilized for separating the funnels along the oppositely directed lines of perforations 28'. In this fashion a sheet of funnels in the form of the roll 90 can be packaged in the container 91, sold to consumers, and utilized for all purposes associated with any typical funnel and, of course, not necessarily limited to oil products. Specifically, the overall combination of FIG. 9 can be utilized in the kitchen to pour through funnels removed from the sheet 45 any conventional products. As an example, bacon grease or fat is poured through funnels into containers and the latter are subsequently discharged, but the funnels are retained and must be cleaned of the grease. It is also conventional for using funnels for pouring paint into containers and in the present case, any funnel can be removed from the sheet 45, used to pour paint, and then discarded. Thus, the consumer can purchase a carton of disposable funnels from a suitable wholesale/retail source, use these as necessary at a very modest cost, and after total use and disposal repurchase like relatively inexpensive cartons of the funnel rolls 90.

Although a preferred embodiment of the invention has been specifically illustrated and described herein, it is to be understood that minor variations may be made in the apparatus and the method without departing from the spirit and scope of the invention, as defined in the appended claims.

We claim:

1. An article of manufacture adapted to be separated into a pair of funnels comprising a pair of generally planar walls, a pair of opposite generally parallel lines of bond defining a pair of longitudinal bonded seams; a third line of bond positioned between, spaced from and in diagonal relationship to said pair of bond lines and defining a diagonal bonded seam, said diagonal bonded seam and one of said longitudinal bonded seams setting-off a first funnel having longitudinally opposite ends defining openings of two different sizes, said diagonal bonded seam and a second of said longitudinal bonded seams setting-off a second funnel having a longitudinally opposite ends defining openings of two different sizes, and means for separating said first and second funnels along said diagonal bonded seam.

2. The article of manufacture as defined in claim 1 wherein said separating means is a line of weakness along which said diagonal bonded seam is torn.

3. The article of manufacture as defined in claim 2 including means for tearing a portion of each funnel adjacent a smaller of its opening to form a larger opening thereat.

4. The article of manufacture as defined in claim 3 wherein said tearing means is a line of weakness.

5. The article of manufacture as defined in claim 1 including means for tearing a portion of each funnel adjacent a smaller of its opening to form a larger opening thereat.

6. An article of manufacture adapted to have removed therefrom individual funnels comprising a pair of generally planar walls, a pair of opposite generally parallel lines of bond defining a pair of longitudinal bonded seams; a third line of bond positioned between, spaced from and in diagonal relationship to said bond lines and defining a diagonal bonded seam, said diagonal bonded seam and one of said longitudinal bonded seams setting-off a first funnel having longitudinally opposite ends defining openings of two different sizes, said diagonal bonded seam and a second of said longitudinal bonded seams setting-off a second funnel having longitudinally opposite ends defining openings of two different sizes, means for separating first and second funnels along said diagonal bonded seam, and said first and second funnels and a further plurality of such funnels formed in the same manner as the first and second funnels being formed into a roll having an axis generally parallel to said parallel lines of bond.

7. The article as defined in claim 6 including a container, and said roll being housed in said container.

8. The article as defined in claim 7 wherein said container has a cover, and said cover has an inclined free edge matching the inclination of one of said diagonal bonded seams.

9. The article as defined in claim 8 wherein said further plurality of funnels are inverted so that the diagonal bonded seams alternate in their inclination; said container includes a container body having a body free edge; and said container body free edge is inclined in matching relationship to the inclination of another of said diagonal bonded seams and opposite to the inclination of said one diagonal bonded seam.

10. The article as defined in claim 9 wherein said cover free edge is the terminal free edge of a flap in contiguous relationship to a panel of said container body.

11. The article as defined in claim 7 wherein said container has a container body, a cover and a container body free edge; and said container body free edge is inclined in matching relationship to the inclination of one of siad diagonal bonded seams.

* * * * *